US010030336B2

(12) United States Patent
Roeckle

(10) Patent No.: US 10,030,336 B2
(45) Date of Patent: Jul. 24, 2018

(54) CONVEYOR SYSTEM FOR TRANSPORTING ARTICLES

(75) Inventor: Juergen Roeckle, Magstadt (DE)

(73) Assignee: EISENMANN SE, Boeblingen (DE)

( * ) Notice: Subject to any disclaimer, the term of this patent is extended or adjusted under 35 U.S.C. 154(b) by 933 days.

(21) Appl. No.: 13/576,695

(22) PCT Filed: Jan. 22, 2011

(86) PCT No.: PCT/EP2011/000261
§ 371 (c)(1),
(2), (4) Date: Jan. 18, 2013

(87) PCT Pub. No.: WO2011/095285
PCT Pub. Date: Aug. 11, 2011

(65) Prior Publication Data

US 2013/0104767 A1 May 2, 2013

(30) Foreign Application Priority Data

Feb. 5, 2010 (DE) ..... 10 2010 007 191

(51) Int. Cl.
*E01B 7/00* (2006.01)
*B61B 13/04* (2006.01)
*B61L 23/00* (2006.01)

(52) U.S. Cl.
CPC ..... *E01B 7/00* (2013.01); *B61B 13/04* (2013.01); *B61L 23/002* (2013.01)

(58) Field of Classification Search
CPC ..... B61L 23/005; B61L 23/002; B65G 37/02; B65G 47/50; B65G 51/36; B65G 51/46; G05D 2201/0216; B61B 3/00; B61B 13/04; E01B 25/22; E01B 7/00
USPC ..... 191/45 A; 104/88.02, 88.03, 88.04, 89, 104/130.01, 130.06, 288, 295, 297; 700/228, 229
See application file for complete search history.

(56) References Cited

U.S. PATENT DOCUMENTS 2,902,945 A 9/1959 Simon
4,630,216 A 12/1986 Tyler et al.
4,766,547 A * 8/1988 Modery et al. ..... 700/229
(Continued)

FOREIGN PATENT DOCUMENTS

DE 10 2008 047 755 A1 4/2009
EP 0 164 302 A2 12/1985
(Continued)

*Primary Examiner* — Mark T Le
(74) *Attorney, Agent, or Firm* — Schroeder Intellectual Property Law Group, LLC

(57) ABSTRACT

A conveyor system for transporting articles, comprising a rail system that comprises a plurality of track sections and at least one switch point, by which, via a switch point drive, a first track section can be connected to a second track section or to a third track section of the rail system. At least one drivable transport trolley can be driven along a path of movement on the rail system. A communications system with comprises at least one communications line that extends along the path of movement of the at least one transport trolley. A trolley communications unit disposed on the at least one transport trolley interacts with the communications line. The switch point drive can be controlled by means of a switch point control system, which is connected to the at least one communications line.

12 Claims, 5 Drawing Sheets

(56) References Cited

U.S. PATENT DOCUMENTS

| | | | | |
|---|---|---|---|---|
| 5,749,547 | A * | 5/1998 | Young | A63H 19/24<br>104/300 |
| 6,109,568 | A | 8/2000 | Gilbert et al. | |
| 2003/0015626 | A1 * | 1/2003 | Wolf | A63H 19/14<br>246/187 A |

FOREIGN PATENT DOCUMENTS

| | | | |
|---|---|---|---|
| EP | 0 242 177 | A2 | 10/1987 |
| EP | 1 216 910 | A1 | 6/2002 |
| EP | 2 067 651 | A1 | 6/2009 |
| FR | 1 380 878 | | 12/1964 |

* cited by examiner

CONVEYOR SYSTEM FOR TRANSPORTING ARTICLES

RELATED APPLICATIONS

This application claims the filing benefit of International Patent Application No. PCT/EP2011/000261, filed Jan. 22, 2011, which claims the filing benefit of German Patent Application No. 10 2010 007 191.9 filed Feb. 5, 2010, the contents of both of which are incorporated herein by reference.

TECHNICAL FIELD AND BACKGROUND OF THE INVENTION

The invention relates to a conveyor system for transporting articles, having a) a rail system which
   aa) includes a plurality of line sections;
   ab) includes at least one set of points by means of which, via a points drive, a first line section may optionally be connected to a second line section or a third line section of the rail system;
b) at least one drivable transport carriage which may be moved along a movement path on the rail system;
c) a communication system which includes at least one communication line that extends along the movement path of the at least one transport carriage;
d) a carriage communication unit which is arranged on the at least one transport carriage and cooperates with the at least one communication line, In commercially known conveyor systems of this kind, points are triggered in conventional manner by means of a central control which coordinates the complete sequence of transport of the articles. To this end, the central control may communicate with the transport carriages by way of the communication line and transmit travel parameters such as the destination, or the speed to be observed, and initiate deceleration or acceleration procedures for each individual transport carriage. Using position detection equipment known from the prior art, the position of each transport carriage on the rail system is detected in real time and transmitted to the central control. Depending on the data available thereto, the central control accordingly actuates a set of points by directly triggering the drive thereof.

To this end, the drive of each set of points is typically connected to the central control by way of a separate cable connection associated therewith. Given the conventional dimensions of a conveyor system, this necessitates corresponding electrical installations on a large scale and over long distances between the central control and the points. These electrical installations have a corresponding effect on the overall costs of a conveyor system of this kind.

SUMMARY OF THE INVENTION

It is thus an object of the invention to provide a conveyor system of the kind mentioned at the outset in which the expense of the necessary electrical installations for connecting the central control to the points is reduced.

This object may be achieved with a device of the kind mentioned at the outset, in that the points drive may be triggered by means of a points controller which is connected to the at least one communication line.

According to the invention, it has been recognised that the communication line already provided may be used along the movement path of the typically plurality of transport carriages in order to transmit control signals for triggering the set of points. To this end, the set of points includes a points controller which is associated with the set of points and is thus decentralised, and which may receive data by way of the communication line and triggers the points drive as a function of the control commands received.

Thus, only a relatively short cable connection is needed between the set of points and the communication line along the rail system. There is no need for an expensive electrical installation as known from the prior art.

The measure according to the invention may be implemented both in the case of single-track and double-track or multiple-track electrical overhead conveyors or ground rail systems.

The points controller may preferably communicate with the at least one transport carriage and/or with a central control by way of the communication line. In principle, it may be sufficient if the points controller is in communication only with the transport carriage or only with the central control. In the former case, the set of points may thus be adjusted individually by each transport carriage separately, or it may be triggered by way of an information chain from the central control to the transport carriage to the set of points. In the second case, the set of points may be triggered centrally by way of the central control. When both communication paths are open, additional parameters may be taken into account and the central control may for example send the set of points a command that is higher-ranking than an individual control from a transport carriage.

It is favourable if the communication line takes the form of a contact conductor, and the points controller is connected to the contact conductor by means of a contact device.

Where appropriate, it is quite possible to use existing communication contact conductors for the communication between the transport carriages and the central control.

As an alternative, it may be favourable if signals may be fed to the communication line, or retrieved therefrom, without contact.

By way of example, leaky waveguides have proved their usefulness in this context.

A technically favourable communication between the communication line and the points controller may be made by way of a data cable.

If there is a power supply line along the movement path of the at least one transport carriage, it may be connected to the points controller such that the set of points may be supplied with electrical power. The power supply line may be fed centrally, as a result of which there is no need for a separate power supply device for each set of points or, in turn, corresponding electrical installations from a central power source to each set of points.

Already existing systems may be extended if the power supply line is a contact conductor which cooperates with a contact conductor device of the at least one transport carriage.

Advantageously, a contact conductor may take the form of a combined communication and power line.

As an alternative, an inductive power supply has proved useful, for which purpose the at least one transport carriage advantageously includes a tapping module by means of which the transport carriage may be supplied with electrical power inductively by way of the power supply line.

A technically simple connection between the power supply line and the points controller may be made by way of a power line, that is to say a cable connection. This is also particularly practical if power is supplied to the transport carriages inductively.

Particularly advantageously, the conveyor system may be operated with a relatively high level of reliability if the supply of electrical power to the power supply line may optionally be maintained or interrupted by means of the points controller, in a safety section of the rail system which is arranged upstream of the set of points, as seen in the direction of transport. As a result of this, the set of points may directly shut down a safety section upstream of it, if for example it adopts an intermediate position in which a transport carriage entering the set of points would be derailed as a result.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

Exemplary embodiments of the invention will be explained in more detail below with reference to the drawings, in which.

DETAILED DESCRIPTION OF THE PRESENT INVENTION

Figure 1:
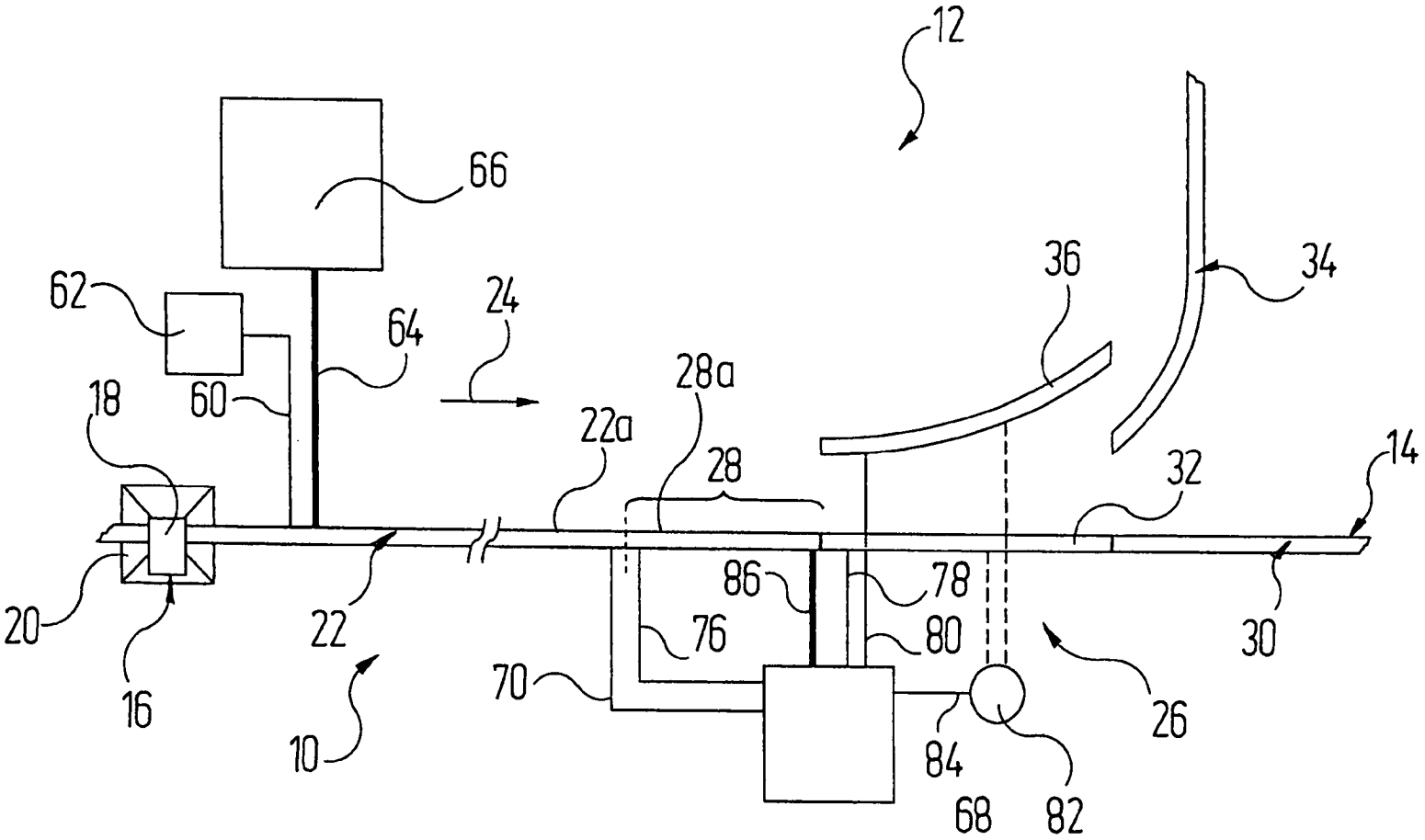
FIG. 1 shows a view from above of a section of an electrical overhead conveyor with a set of points in a first position, in which it connects a first line section to a second line section.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Figure 2:
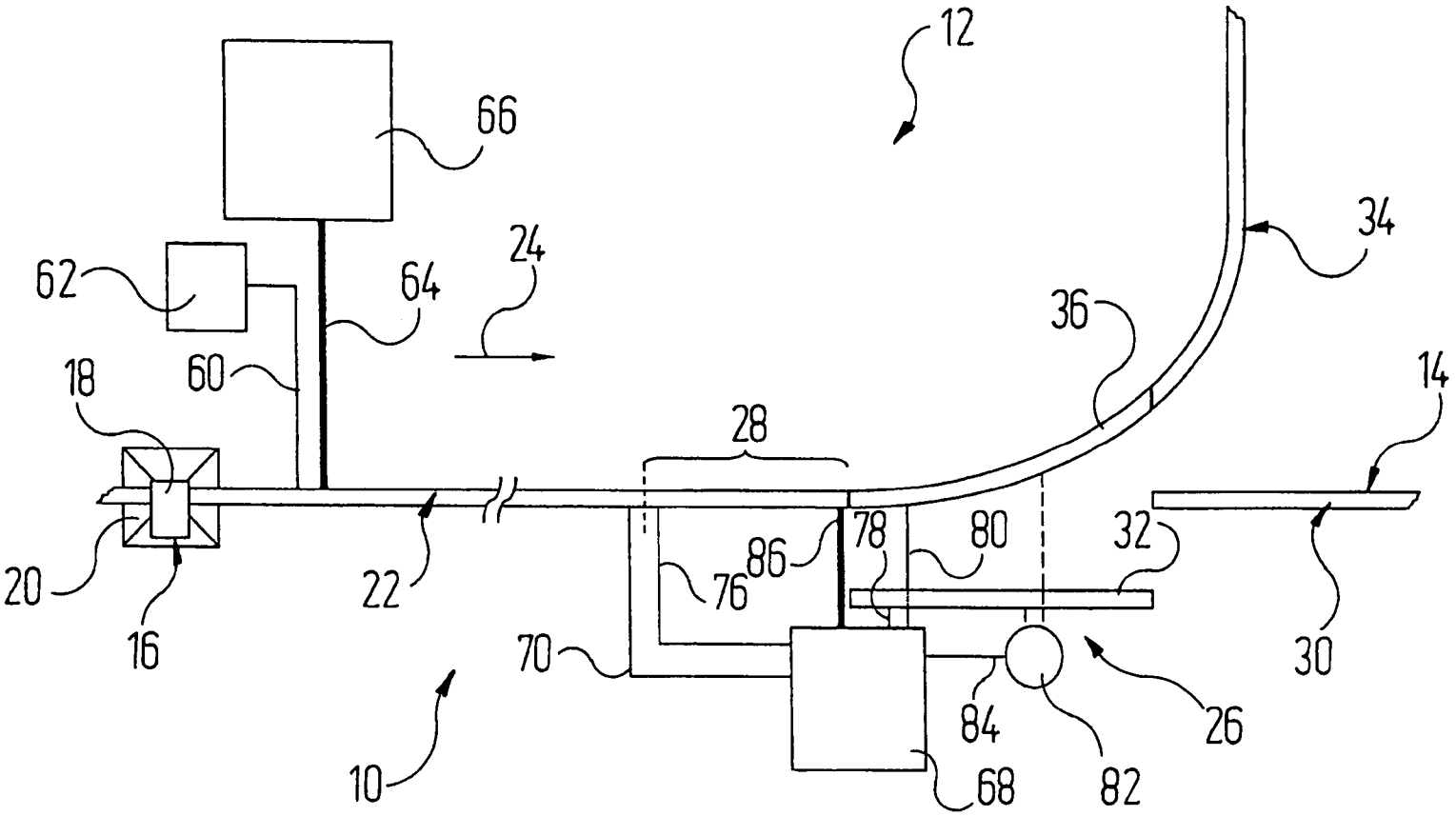
FIG. 2 shows a view, corresponding to FIG. 1, of the section of the electrical overhead conveyor with the set of points in a second position, in which it connects the first line section to a third line section.

FIGS. 1 and 2 show, in a view from above, a detail of a rail system 10 of a conveyor system in the form of an electrical overhead conveyor 12. The principle which is explained below by way of the example of the electrical overhead conveyor 12 may, as an alternative, also be used in other rail systems, in particular also in ground rail systems.

In the present exemplary embodiment, the rail system 10 is single-track and includes a mounting rail 14 which, in conventional manner, takes the form of an I-shaped profile. It runs above the level of the floor of the room and is suspended, in a manner known per se, from a holding construction (not itself shown) which requires no further explanation.

A plurality of transport carriages 16, of which only one is shown in FIGS. 1 and 2, may be moved on the mounting rail 14. The transport carriage 16 includes a traversing gear 18 which grips around the mounting rail 14, as known from the prior art, for which reason it does not need to be described further. The traversing gear 18 is connected to an overhead transport system 20 in which material to be conveyed is accommodated.

The rail system 10 of the electrical overhead conveyor 12 includes a plurality of line sections which are each connected to one another by sets of points. In FIGS. 1 and 2, a first line section 22 of the rail system 10 can be seen, on which the transport carriages 16 move in a direction of transport 24. The first line section 22 is arranged upstream of a set of points 26, as seen in this direction of transport 24. An end section of the first line section 22 which is adjacent to the set of points 26 forms a safety rail section 28. More detail will be given about this below.

A second line section 30 is arranged downstream of the set of points 26, as seen in the direction of transport 24. This line section 30 is connected, by way of a straight points rail 32 of the set of points 26, to the first line section 22 when the set of points 26 adopts a first points position, shown in FIG. 1.

A third line section 34, also arranged downstream of the set of points 26 as seen in the direction of transport 24, is connected, by way of a curved points rail 36 of the set of points 26, to the first line section 22 when the set of points 26 adopts a second points position, shown in FIG. 2.

Figure 4:
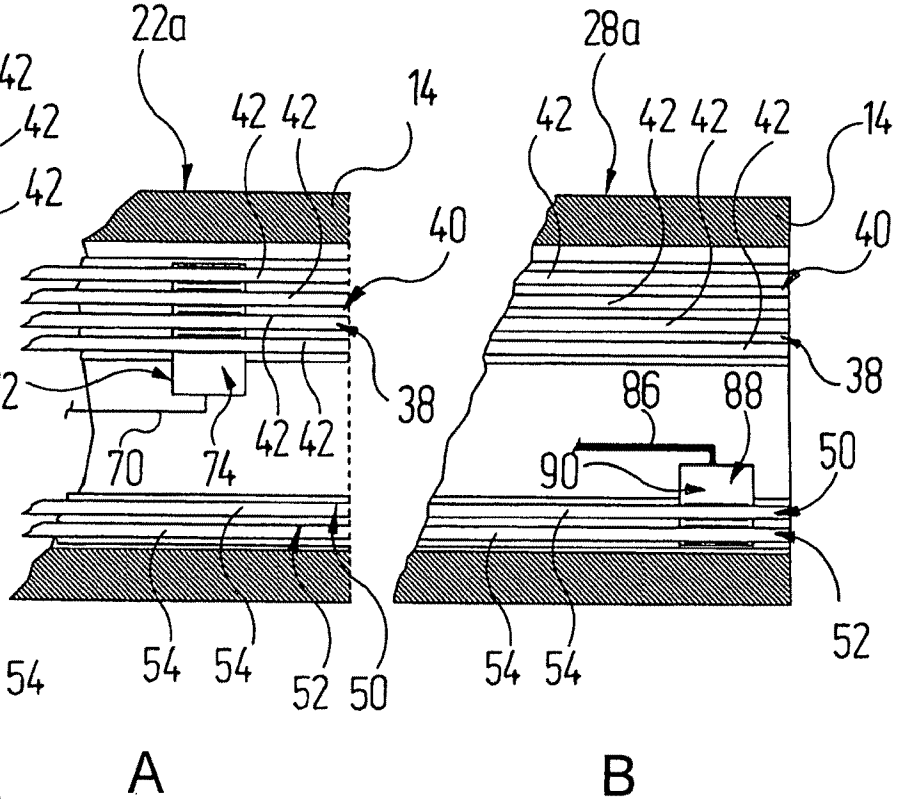
FIGS. 4A and 4B show, in relation to the first exemplary embodiment, a side view of the mounting rail of the conveyor system at two different points on the first line section.
Figure 3:
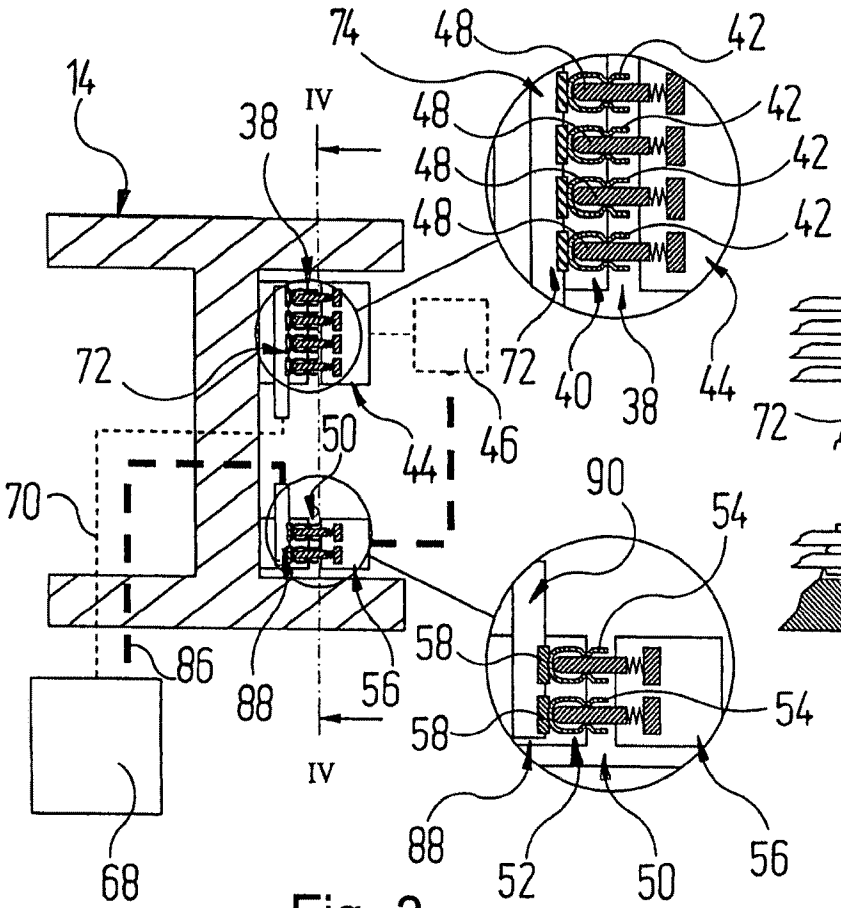
FIG. 3 shows a section through a mounting rail, wherein components for power transmission and for communication in both the set of points and a transport carriage are shown in a first exemplary embodiment.

The mounting rail 14 carries a power supply line 38 along the movement path of the transport carriages 16, and in a first exemplary embodiment, shown in FIGS. 3 and 4, this power supply line 38 takes the form of a multiple-core contact conductor 40. By way of example, FIGS. 3 and 4 show four cores 42 of the contact conductor 40, which take the form of copper lines of a longitudinal section which are thus C-shaped in cross section. The contact conductor 40 typically includes three cores for the phases of three-phase current and one core which is at earth potential. Optionally, another core may be present as the neutral conductor. Where appropriate, the contact conductor 40 may also include a pair of cores forming a pair of poles for low voltage, by way of which any control elements, sensors or actuators which are present on the transport carriages 16 may be supplied with current.

It is also possible for further current-carrying contact conductors to be provided in order where necessary to supply additional operating components with current.

To collect current, each transport carriage 16 includes a contact conductor device 44 which is guided with it and is connected to a transport carriage controller 46 of the transport carriage 16, indicated simply by dashed lines in FIG. 3. The contact conductor device 44 has spring-mounted carbon fingers 48, each of which projects through the associated longitudinal slot into a respective core 42 and makes contact with the inner surface thereof.

In addition, the mounting rail 14 carries a communication line 50 along the movement path of the transport carriages 16, and in the exemplary embodiment shown in FIGS. 3 and 4 this communication line 50 also takes the form of a multiple-core contact conductor; this is designated by the reference numeral 52. By way of example, two cores 54 of the contact conductor 52 are shown, which also take the form of copper lines which are C-shaped in cross section.

To transmit data, each transport carriage 16 includes a carriage communication unit in the form of a contact device 56 which is guided with it and is connected to the transport carriage controller 46 of the transport carriage 16. The contact device 56 also has, for its part, spring-mounted carbon fingers 58, each of which projects through the associated longitudinal slot into a respective core 54 and makes contact with the inner surface thereof, as a result of which a signal may be transmitted.

The power supply line 38 of the mounting rail 14 is fed by way of a first supply feed line 60 from a central power supply device 62 (see FIGS. 1 and 2). The communication contact conductor 52 of the mounting rail 14 is connected, by way of a bidirectional main data line 64, to a central control 66 such that the latter can feed communication data to the communication contact conductor 52 of the mounting rail 16 and retrieve it therefrom. In the figures, lines serving for data transmission are always illustrated by a thicker line than those of power lines.

The central control 66 may communicate by way of the communication contact conductor 52 with any transport carriage 16 at any point on the rail system 12. Various standardised communication systems are suitable for data transmission, e.g. AS-i, RS485 or CAN bus systems, or Ethernet.

As can be seen from FIGS. 1 and 2, the set of points 26 includes a points controller 68. This is connected by way of a power tapping line 70 to the power supply line 38 on the mounting rail 14, by way of which the set of points 26 is supplied with power.

The power tapping line 70 is connected to the power supply line 38 in a region 22*a* just upstream, as seen in the direction of transport 24, of the safety section 28 of the first line section 22 of the rail system 10. For this purpose, a tapping module 72 is arranged there, and in the exemplary embodiment shown in FIGS. 3 and 4 this takes the form of a contact device 74 which makes contact with the cores 42 of the contact conductor 40 on the side thereof facing the mounting rail 14.

FIG. 4A shows a side view of the rail region 22*a* of the mounting rail 14, wherein the contact device 74 arranged behind the contact conductor 40, as seen in this direction of view, is visible. The contact conductor device 44 of the transport carriage 16, shown in FIG. 3, has been omitted here for the sake of clarity.

The section of the power supply line 38 which runs along the safety section 28 of the mounting rail 14 forms a separate line region and is not fed from the central power supply device 62 but, by means of the points controller 68, by way of a second power feed line 76. With the aid of the points controller 68, the power supply to the safety section 28 may optionally be interrupted. More detail will be given about this below.

When the set of points 26 adopts its first points position, the points controller 68 also supplies the power supply line 38 with current in the region of the straight points rail 32, by way of a third power feed line 78. Correspondingly, the points controller 68 supplies the power supply line 38 with current in the region of the curved points rail 36, by way of a fourth power feed line 80, when the set of points 26 adopts its second points position.

The set of points 26 includes a points drive 82 by means of which it may be moved out of its first points position into its second points position, and out of its second points position into its first points position. The mechanical coupling between the points drive 82 and the points rails 32 and 36 is indicated in FIGS. 1 and 2 by means of dashed lines.

The points drive 82 is triggered by way of the points controller 68 and is supplied with current thereby by way of a fifth power feed line 84.

The points controller 68 is connected, by way of a bidirectional points data line 86, to the communication line 50 on the mounting rail 14. As a result of this, the points controller 68 may exchange data and communicate with the central control 66 on the one hand and with any of the transport carriages 16 on the other, for which purpose the respective communication systems must be correspondingly compatible.

At the end region 28*a* of the safety section 28 which is adjacent to the set of points 26, the points data line 86 is coupled by way of a transmission unit 88 to the communication line 50 of the mounting rail 14. In the exemplary embodiment shown in FIGS. 3 and 4, the transmission unit 88 takes the form of a data contact device 90 which makes contact with the two cores 54 of the contact conductor 52 on the side thereof facing the mounting rail 14.

FIG. 4B shows the end region 28*a* of the safety section 28 in a side view, and the transmission unit 88 which is arranged behind the contact conductor 40, as seen in this direction of view. The data contact device 56 of the transport carriage 16, visible in FIG. 3, is not shown in FIG. 4B for the sake of clarity.

Figure 6:
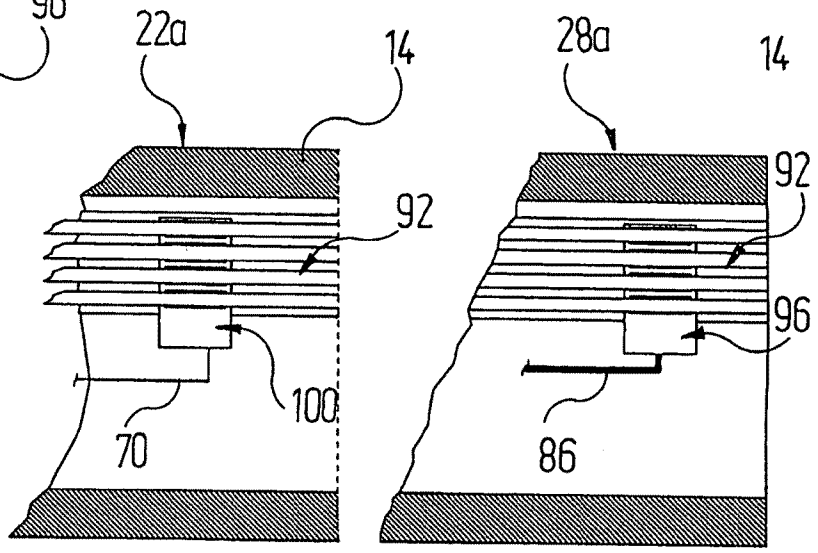
FIGS. 6A and 6B show, in relation to the second exemplary embodiment, a side view of the mounting rail of the conveyor system at two different points on the first line section.
Figure 5:
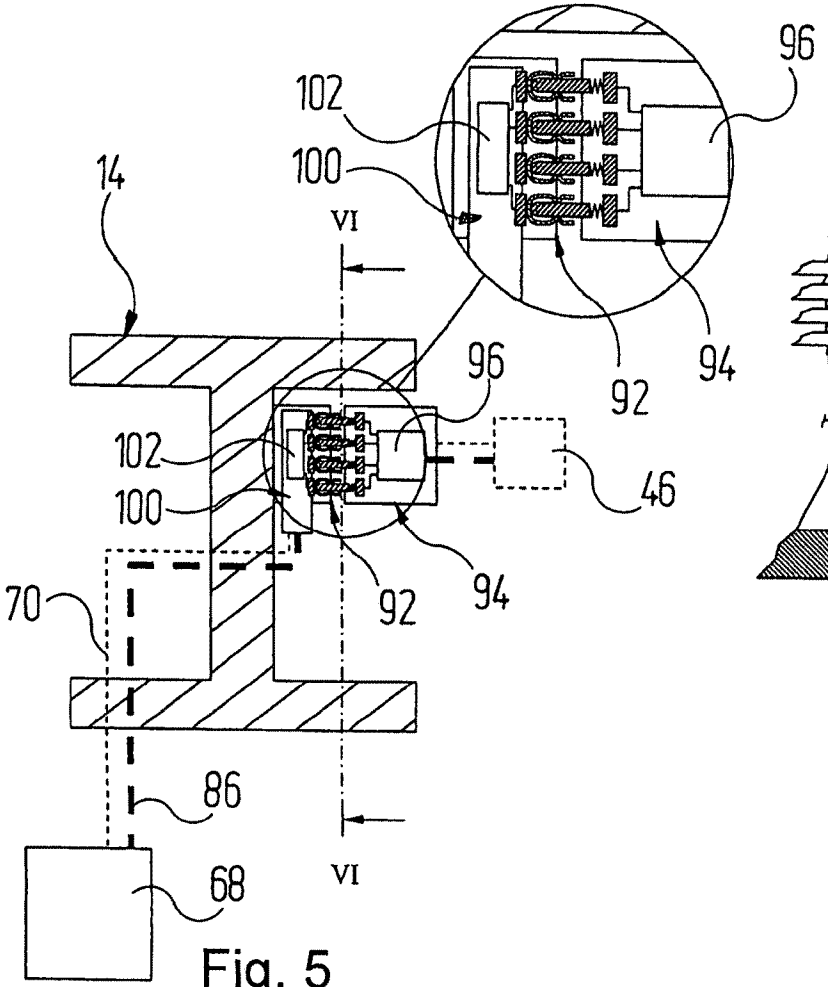
FIG. 5 shows a section through the mounting rail, wherein modified components for power transmission and for communication in both the set of points and the transport carriage are shown in a second exemplary embodiment.

FIGS. 5 and 6 show, as a second exemplary embodiment, a modification to the power and data transmission.

Unlike the exemplary embodiment in FIGS. 3 and 4, in this case the power supply line 40 and the communication line 50 are combined in a single contact conductor 92 which both carries current and transmits data signals. Data transmission by way of current-carrying lines is known per se, by the term PowerLAN.

To collect power and data, the transport carriages 16 have a contact conductor device 94 by way of which the respective transport carriage 16 is both supplied with current and exchanges data with its transport carriage controller 46. For this purpose, a signal processing unit 96 is integrated in the contact conductor device 94, and this filters out the data signals or as appropriate feeds them to the contact conductor 92.

In a similar way, the points controller 68 may also be coupled, by way of a contact device 100 having an integrated signal processing unit 102, to the contact conductor 92. In this case, the points data line 86 also leads to the end region 22*a* of the first line section 22 upstream of the safety section 28, where the contact device 100 is accordingly arranged. As an alternative, however, the power supply and data transfer of the points controller 68 may also take place separately from one another, as is the case in the exemplary embodiment according to FIGS. 3 and 4. This is shown in FIGS. 6A and 6B.

Figure 7:
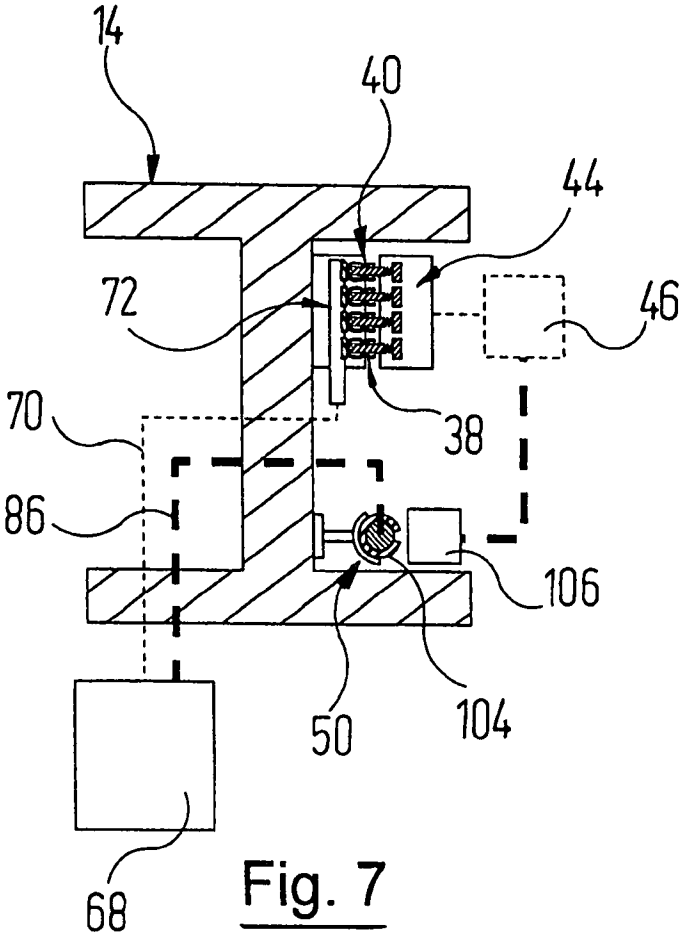
FIG. 7 shows a section through the mounting rail, wherein modified components for communication in both the set of points and the transport carriage are shown in a third exemplary embodiment.

FIG. 7 shows, as a third exemplary embodiment, a modification to the data transmission.

Instead of the communication contact conductor 52 in the first exemplary embodiment according to FIGS. 3 and 4, the communication line 50 here takes the form of a leaky waveguide 104, as is known per se.

The transport carriage 16 carries with it a receiving and sending aerial 106 which is guided, at all times in leak-proof manner, along the leaky waveguide 104. As a standardised communication system Ethernet may for example be used.

The points data line 86 of the points controller 68 is in this case connected by way of a direct cable connection to the core of the leaky waveguide 104, which is simply indicated in FIG. 7.

Figure 8:
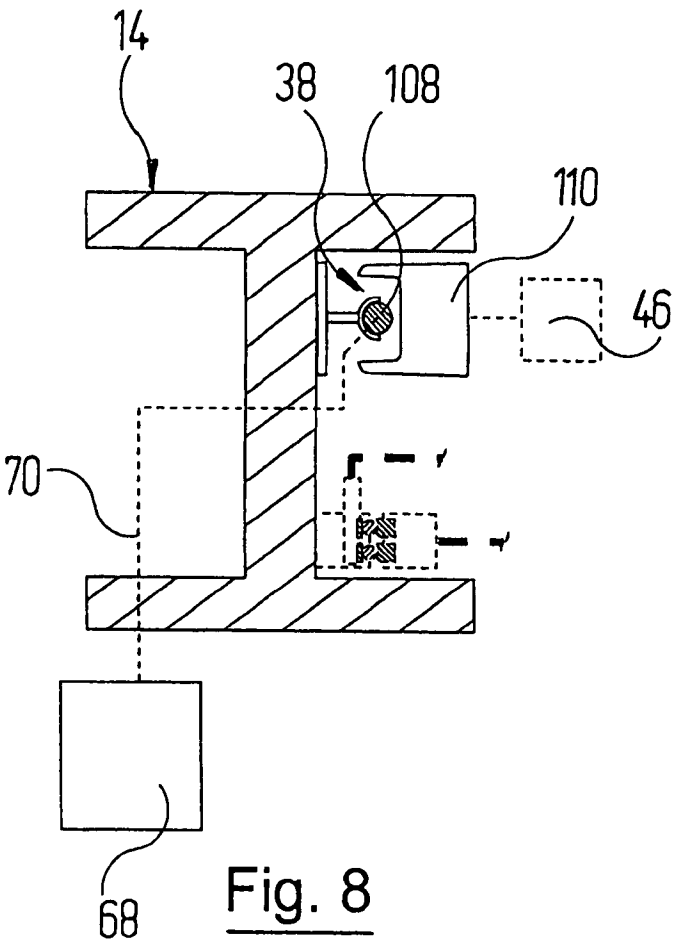
FIG. 8 shows a section through the mounting rail, wherein modified components for power transmission in both the set of points and the transport carriage are shown in a fourth exemplary embodiment.

FIG. 8 shows, as a fourth exemplary embodiment, a modification to the power supply.

In this case, power is supplied inductively to the transport carriages 16, and for this purpose the power supply line 38 takes the form of a current-carrying cable 108. For the purpose of power tapping, the transport carriages 16 each carry with them a tapping module 110, called a pick-up module, as is known per se. This module grips around the cable 108, as can be seen in FIG. 8, and is connected to the transport carriage controller 46.

The power tapping line 70 for the points controller 68 is in this case connected by way of a direct cable connection to the current-carrying cable 108, which is simply indicated in FIG. 8.

Here, data transmission may be performed in any desired way, and for this reason the components for data transmission are only shown in dashed lines in FIG. 8 and are not designated by reference numerals.

Regardless of the type of power transmission or communication, the electrical overhead conveyor 12 described above operates as follows:

The transport carriages 16 communicate bidirectionally with the central control 66, which coordinates the travel of the transport carriages 16 and sends corresponding signals to the individual transport carriages 16. These in turn send data back to the central control, e.g. data on the current speed, acceleration or deceleration and data relating to position. To determine the position of a transport carriage on the rail system 10, any established techniques may be used.

In addition to the central control 66 and the transport carriages 16, however, the points controller 68 is also integrated into communication. The points controller 68 may exchange information with any transport carriage 16 at any desired point on the rail system 10 and with the central control 66, by way of the communication line 50.

To trigger the set of points 26, for example it is possible to make use of the communication between a transport carriage 16 which approaches the set of points 26 in the direction of transport 24 and the points controller 68.

Stored in the points controller 68 is the points position which the set of points 26 has to adopt so that a transport carriage 16 is guided appropriately from the first line section 22 to the second or third line section 30 and 34 respectively so that it can reach its destination.

Let us assume that the set of points 26 is in its first points position (see FIG. 1) and has to adopt its second points position (see FIG. 2) so that a transport carriage can arrive at its destination Z.

When a certain transport carriage 16 with the destination Z approaches the set of points 26 in the direction of transport 24, it transmits to the points controller 68 a signal which signifies "my destination is Z". The points controller 68 then supplies the points drive 82 with current such that the set of points 26 moves into the second points position.

As a safety measure, the points controller 68 interrupts the supply of current to the safety section 28 of the first line section 22 during the transition from the first points position to the second. This means that the power supply line 38 carries no current along the safety section 28 as long as the set of points is in an intermediate position between the first and the second points position.

If the transport carriage 16 enters the safety section 28 before the set of points 26 has adopted its second points position, the transport carriage 16 is no longer supplied with current and it decelerates on the mounting rail 14, in the safety section 28. The safety section 28 is accordingly selected to be long enough for a transport carriage 16 to come to a standstill upstream of the set of points 26 if it is no longer supplied with power.

In this way, it is ensured that a transport carriage 16 cannot enter the set of points 26 if the latter is in an intermediate position in which the transport carriage 16 would be derailed and would fall from the mounting rail 14.

As soon as the set of points 26 has adopted its second points position, the power supply line 38 is supplied with current again along the safety section 28, such that a transport carriage 16 which is located thereon can start to move again, or a transport carriage 16 arriving at the safety section 28 can continue its travel unchanged.

For this reason, communication between the set of points 26 and the transport carriage 16 is planned to take place upstream of the safety section 28, so that the transport carriage 16 only enters the safety section 28 if power is supplied to the latter again.

The procedures described above are performed accordingly in an analogous manner when the set of points is moved out of the second points position and into the first points position.

Because power is supplied to the points controller 68 and hence to the set of points 26 by way of the power supply line 38 along the mounting rail 14, there is no need for the long cables which otherwise have to be laid over relatively long distances from the power supply device 62 to a respective set of points 26.

Because the points controller 68 also communicates with the central control 66, and can receive commands, by way of the communication line 50, the set of points 26 may also be triggered by way of the central control 66 if a change in circumstances necessitates this.

The set of points 26 may additionally be triggered manually, by way of external means such as a key panel or a remote control unit, by a member of the operating staff who where appropriate has first to enter an authentication code.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A conveyor system for transporting articles, comprising:

a rail system which includes a plurality of line sections;

at least one set of points by means of which, via a points drive, a first line section is connectable to either a second line section or a third line section, wherein the points drive is triggered by a points controller;

at least one drivable transport carriage which is movable along a movement path on the rail system, the at least one drivable transport carriage having a carriage communication unit arranged thereon;

a central control for providing at least one control signal to the at least one drivable transport carriage;

a communication system which includes a communication line extending along the movement path, wherein the carriage communication unit of the at least one drivable transport carriage contacts the communication line to facilitate bi-directional communication between the at least one drivable transport carriage and the central control, the points controller communicates with at least one of the at least one drivable transport carriage or the central control via the communication line, and the points controller communicates with both of the at least one drivable transport carriage and the central control by way of the communication line.

2. The conveyor system according to claim 1, wherein the communication line takes the form of a contact conductor, and the points controller is connected to the contact conductor by means of a contact device.

3. The conveyor system according to claim 1, wherein signals are fed to the communication line, or retrieved therefrom, without contact.

4. The conveyor system according to claim 3, wherein the communication line is a leaky waveguide.

5. The conveyor system according to claim 3, wherein the communication line is connected to the points controller by way of a data cable.

6. The conveyor system according to claim 1, wherein there is a power supply line along the movement path which is connected to the points controller such that the set of points are supplied with electrical power.

7. The conveyor system according to claim 6, wherein the power supply line is a contact conductor which cooperates with a contact conductor device of the at least one drivable transport carriage.

8. The conveyor system according to claim 7, wherein the contact conductor is a combined communication and power line.

9. The conveyor system according to claim 7, wherein the at least one drivable transport carriage includes a tapping module by means of which the transport carriage is supplied with electrical power inductively by way of the power supply line.

10. The conveyor system according to claim 6, wherein the power supply line is connected to the points controller by way of a power line.

11. The conveyor system according to claim 6, wherein supply of electrical power to the power supply line is optionally maintained or interrupted by means of the points controller, in a safety section of the rail system which is arranged upstream of the set of points, as seen in a direction of transport.

12. The conveyor system according to claim 1, wherein the communication line includes multiple cores.

* * * * *